US009533348B2

(12) United States Patent
Satoh et al.

(10) Patent No.: US 9,533,348 B2
(45) Date of Patent: Jan. 3, 2017

(54) CENTRIFUGAL CASTING APPARATUS

(71) Applicant: IHI Corporation, Koto-ku (JP)

(72) Inventors: Shigeyuki Satoh, Tokyo (JP); Kazuyoshi Chikugo, Tokyo (JP)

(73) Assignee: IHI Corporation, Koto-ku (JP)

( * ) Notice: Subject to any disclaimer, the term of this patent is extended or adjusted under 35 U.S.C. 154(b) by 49 days.

(21) Appl. No.: 14/712,528

(22) Filed: May 14, 2015

(65) Prior Publication Data

US 2015/0246390 A1 Sep. 3, 2015

Related U.S. Application Data

(63) Continuation of application No. PCT/JP2013/083505, filed on Dec. 13, 2013.

(30) Foreign Application Priority Data

Jan. 10, 2013 (JP) ..... 2013-002416

(51) Int. Cl.
*B22D 13/10* (2006.01)
*B22C 9/00* (2006.01)
(Continued)

(52) U.S. Cl.
CPC ..... *B22D 13/101* (2013.01); *B22C 1/00* (2013.01); *B22C 7/02* (2013.01); *B22C 9/00* (2013.01);
(Continued)

(58) Field of Classification Search
CPC ..... B22D 13/04; B22D 13/10; B22D 13/101; B22D 27/04; B22C 9/00
(Continued)

(56) References Cited

U.S. PATENT DOCUMENTS 3,899,020 A * 8/1975 Sekimoto ..... B22D 13/101 164/114
4,167,381 A * 9/1979 Hilmoe ..... B29C 33/306 164/289

FOREIGN PATENT DOCUMENTS

CN 201295748 Y 8/2009
CN 201577003 U 9/2010
(Continued)

OTHER PUBLICATIONS

Combined Office Action and Search Report issued Feb. 14, 2016 in Chinese Patent Application No. 201380067763.1 (with English translation of Categories of Cited Documents).
(Continued)

*Primary Examiner* — Kevin P Kerns
(74) *Attorney, Agent, or Firm* — Oblon, McClelland, Maier & Neustadt, L.L.P.

(57) ABSTRACT

A centrifugal casting apparatus includes a mold holder placed on a freely rotatable rotary table, and a mold put into and held by the mold holder. The mold holder includes a mold holder body made of a metal material and having a bottomed cylindrical shape, heat insulation members provided on an inner peripheral surface and a bottom surface of the mold holder body, and mold positioning members each made of a ceramic and provided to protrude from the heat insulation member on the bottom surface of the mold holder body. The mold includes a mold body having a cavity into which a molten metal is to be poured, and a mold base provided to the mold body and having mold positioning member insertion holes engageable with the mold positioning members.

7 Claims, 7 Drawing Sheets

(51) Int. Cl.

| | |
|---|---|
| ***B22C 1/00*** | (2006.01) |
| ***B22D 13/04*** | (2006.01) |
| ***B22D 27/04*** | (2006.01) |
| ***B22C 7/02*** | (2006.01) |
| ***B22C 9/04*** | (2006.01) |
| ***B22C 21/14*** | (2006.01) |
| ***B22D 27/15*** | (2006.01) |

(52) U.S. Cl.
CPC ..... *B22C 9/04* (2013.01); *B22C 21/14* (2013.01); *B22D 13/04* (2013.01); *B22D 13/10* (2013.01); *B22D 27/04* (2013.01); *B22D 27/15* (2013.01)

(58) Field of Classification Search
USPC ..... 164/286, 292
See application file for complete search history.

(56) References Cited

FOREIGN PATENT DOCUMENTS

| | | | |
|---|---|---|---|
| CN | 102744385 | A | 10/2012 |
| JP | 61-063342 | U | 4/1986 |
| JP | 61-066342 | U | 4/1986 |
| JP | 61-176459 | A | 8/1986 |
| JP | 61-193761 | A | 8/1986 |
| JP | 04-081254 | A | 3/1992 |
| JP | 06-000612 | A | 1/1994 |
| JP | 08-187573 | A | 7/1996 |
| JP | 08-187673 | A | 7/1996 |
| JP | 2000-280054 | A | 10/2000 |
| JP | 2008-238264 | A | 10/2008 |
| JP | 2010-149173 | A | 7/2010 |
| JP | 2011-121064 | A | 6/2011 |
| JP | 2011-121108 | A | 6/2011 |
| JP | 2011-136351 | A | 7/2011 |
| JP | 2012-040590 | A | 3/2012 |
| KR | 10-1011331 | B1 | 1/2011 |

OTHER PUBLICATIONS

International Search Report issued Mar. 25, 2014 in PCT/JP2013/083505 filed Dec. 13, 2013.
Extended European Search Report issued Jun. 20, 2016 in Patent Application No. 13870600.7.
International Search Report issued Mar. 25. 2014 in PCT/JP2013/083505 filed Dec. 13, 2013.

* cited by examiner

CENTRIFUGAL CASTING APPARATUS

CROSS REFERENCE TO RELATED APPLICATIONS

This application is a continuation application of International Application No. PCT/JP2013/83505, filed on Dec. 13, 2013, which claims priority to Japanese Patent Application No. 2013-2416, filed on Jan. 10, 2013, the entire contents of which are incorporated by references herein.

BACKGROUND

1. Field

The present disclosure relates to a centrifugal casting apparatus, or more specifically, to a centrifugal casting apparatus for precisely casting a titanium aluminide precision casting product, a titanium alloy precision casting product, a nickel alloy precision casting product, and the like by centrifugal casting.

2. Description of the Related Art

In the case of a conventional centrifugal casting apparatus, attachment of a mold employs a method of inserting a mold into a cylindrical tube disposed on a rotary table, and positioning and fixing a mold by filling a ceramic heat insulation material and the like in a gap between the cylindrical tube and the mold, or a method of positioning and fixing a mold onto a rotary table by lashing the mold with a belt or the like.

Japanese Patent Application Publication No. Hei 4-81254 (Patent Literature 1) describes a technique for precision centrifugal molding, in which a mold is fastened and fixed to a fixation frame on a rotary base of a centrifugal casting apparatus by using a metal belt.

SUMMARY

Meanwhile, in the method of positioning and fixing the mold by filling the ceramic heat insulation material and the like in the gap between the cylindrical tube and the mold as described above, a step of filling the ceramic heat insulation material and the like and a step of positioning the mold take time, whereby the operation to attach the mold may be complicated. Also, in the case of lashing the mold with the belt or the like, a step of lashing the mold and a step of positioning the mold take time, whereby the operation to attach the mold may be complicated. Furthermore, in the case of attaching a mold which is preheated in a preheating furnace, such complicated operation to attach the mold may lower the temperature of the mold so significantly that a casting product may develop a defect and the like.

In view of the above, an object of the present disclosure is to provide a centrifugal casting apparatus which allows easier attachment of a mold.

A centrifugal casting apparatus according to the present disclosure includes a mold holder placed on a freely rotatable rotary table, and a mold put into and held by the mold holder. Here, the mold holder includes a mold holder body made of a metal material and having a bottomed cylindrical shape, heat insulation members provided on an inner peripheral surface and a bottom surface of the mold holder body, and a mold positioning member made of a ceramic and provided to protrude from the heat insulation member on the bottom surface of the mold holder body. The mold includes a mold body made of an oxide and having a cavity into which a molten metal is to be poured, and a mold base made of an oxide, provided to the mold body, and having a mold positioning member insertion hole engageable with the mold positioning member.

The centrifugal casting apparatus according to the present disclosure includes the multiple mold positioning members, and the multiple mold positioning member insertion holes.

In the centrifugal casting apparatus according to the present disclosure, one of the mold positioning members is provided in the center of the heat insulation member on the bottom surface of the mold holder body and the remaining mold positioning members are provided on a peripheral edge of the heat insulation member on the bottom surface of the mold holder body. Moreover, one mold positioning member insertion hole is provided in the center of the mold base and the remaining mold positioning member insertion holes are provided on a peripheral edge of the mold base.

In the centrifugal casting apparatus according to the present disclosure, the remaining mold positioning member insertion holes provided on the peripheral edge of the mold base are each formed into a cutout hole.

In the centrifugal casting apparatus according to the present disclosure, each mold positioning member is made of any of silicon nitride, silicon carbide, and zirconium oxide.

In the centrifugal casting apparatus according to the present disclosure, the mold includes multiple support members provided to the mold body in radial arrangement and designed to support the mold by bringing tip ends thereof into contact with the heat insulation member provided on the inner peripheral surface of the mold holder body.

In the centrifugal casting apparatus according to the present disclosure, the preheated mold is held by the mold holder.

According to the above-described configuration, the mold holder includes the mold positioning member while the mold includes the mold base which is provided with the mold positioning member insertion hole engageable with the mold positioning member. Hence, the mold can be easily positioned into the mold holder by attaching the mold while bringing the mold positioning member insertion hole of the mold base in engagement with the mold positioning member of the mold holder. Thus, it is possible to attach the mold more easily.

DESCRIPTION OF EMBODIMENTS

Figure 1:
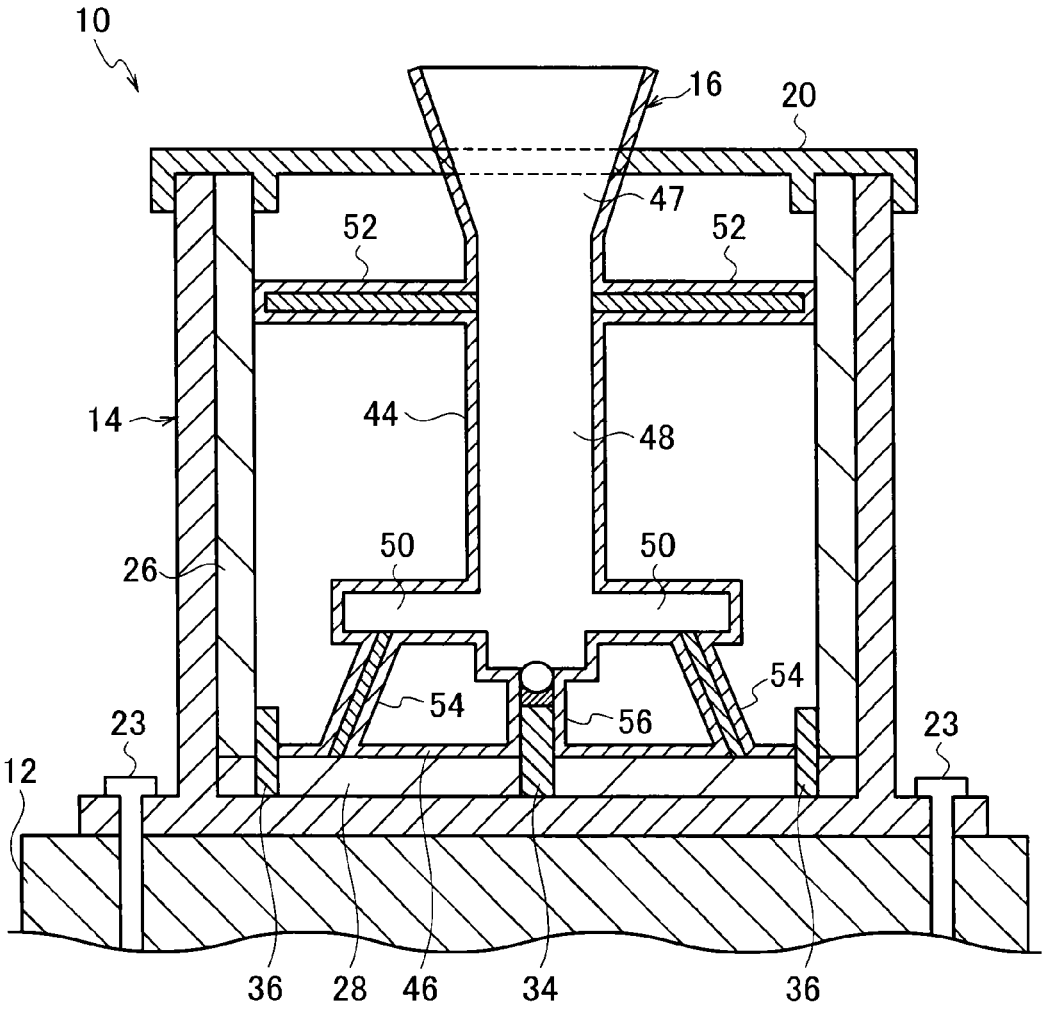
FIG. 1 is a cross-sectional view showing a configuration of a centrifugal casting apparatus according to an embodiment of the present disclosure.

An embodiment of the present disclosure will be described below in detail with reference to the drawings. FIG. 1 is a cross-sectional view showing a configuration of a centrifugal casting apparatus 10. The centrifugal casting apparatus 10 includes a mold holder 14 placed on a rotary table 12 which is freely rotatable, and a mold 16 to be put into and held by the mold holder 14.

Figure 2:
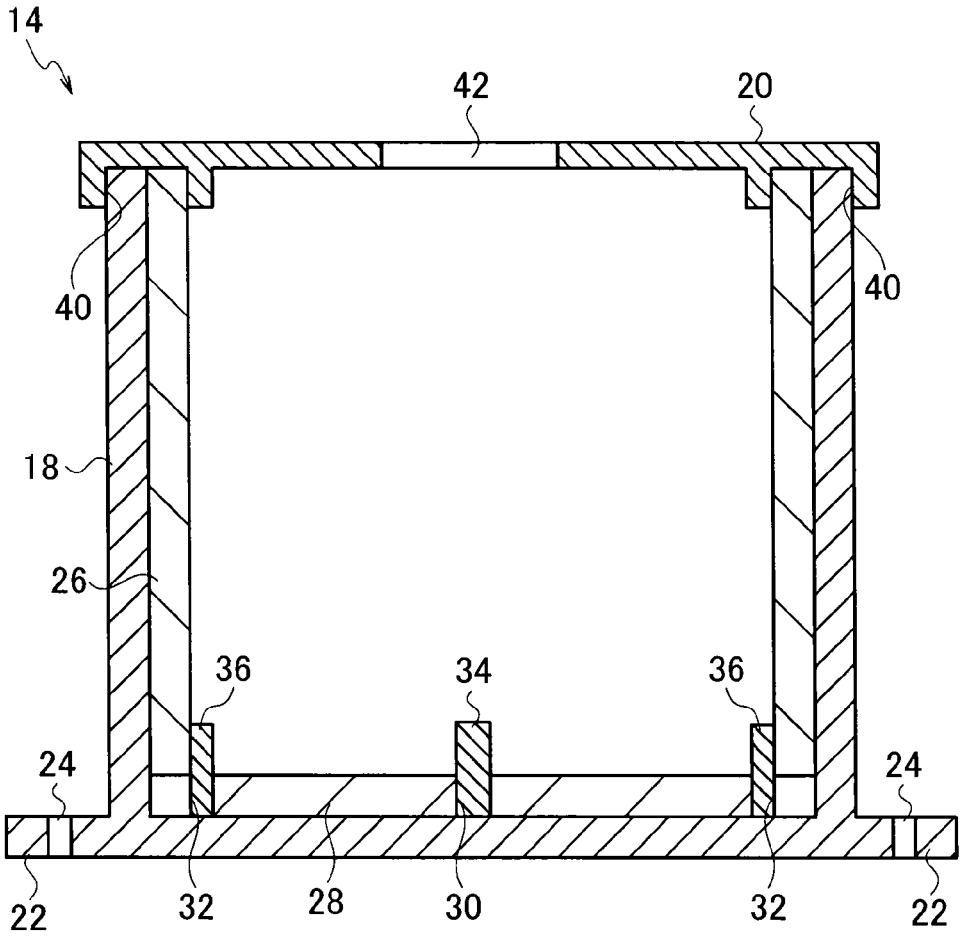
FIG. 2 is a cross-sectional view showing a configuration of a mold holder according to the embodiment of the present disclosure.

FIG. 2 is a cross-sectional view showing a configuration of the mold holder 14. The mold holder 14 includes a mold holder body 18 formed into a bottomed cylindrical shape like a cylinder provided with a bottom, and a lid body 20 designed to close an opening on an upper side of the mold holder body 18. The mold holder body 18 is made of a metal material such as stainless steel. At a peripheral edge on the bottom of the mold holder body 18, a flange 22 is provided in a circumferential direction in such a way as to protrude outward. The flange 22 is provided with fastening holes 24 used for fastening the mold holder 14 to the rotary table 12 with fastening members 23 such as bolts. For example, the fastening holes 24 are provided at four positions at substantially regular intervals in the circumferential direction.

A tubular heat insulation member 26 having a shape of a cylinder, for instance, is provided on an inner peripheral surface of the mold holder body 18. In one embodiment, the tubular heat insulation member 26 may have dimensions of an outside diameter of 425 mm, a height of 380 mm, and a thickness of 10 mm, for example. A flat plate-shaped heat insulation member 28 having a shape of a disc, for instance, is provided on a bottom surface of the mold holder body 18. In one embodiment, the flat plate-shaped heat insulation member 28 may have dimensions of an outer diameter of 445 mm and a thickness of 10 mm, for example. The tubular heat insulation member 26 and the flat plate-shaped heat insulation member 28 are each made of a ceramic such as silicon nitride ($Si_3N_4$), silicon carbide (SiC), and zirconium oxide ($ZrO_2$). The tubular heat insulation member 26 and the flat plate-shaped heat insulation member 28 may be each made of any of silicon nitride ($Si_3N_4$) and silicon carbide (SiC), because these materials are excellent in thermal shock resistance and in mechanical characteristics. The tubular heat insulation member 26 and the flat plate-shaped heat insulation member 28 may be formed separately from each other or formed integrally with each other. The tubular heat insulation member 26 and the flat plate-shaped heat insulation member 28 may be fixed to the mold holder body 18 or may be provided detachably from the mold holder body 18.

Figure 3:
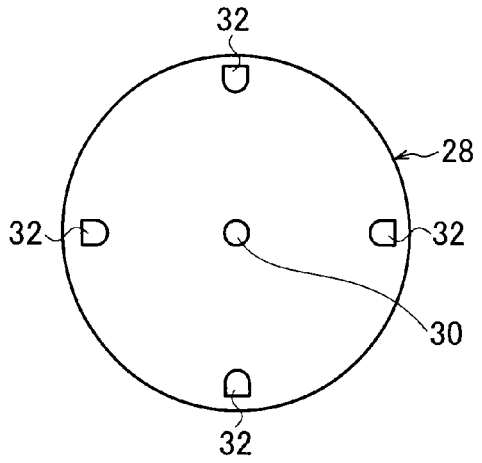
FIG. 3 is a plan view showing a configuration of a flat plate-shaped heat insulation member according to the embodiment of the present disclosure.
Figure 4A:
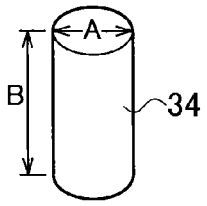
FIG. 4A is a view showing configuration of a mold positioning member according to the embodiment of the present disclosure.
Figure 4B:
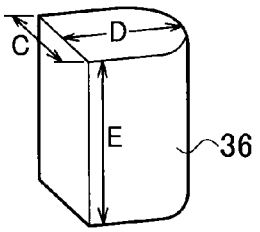
FIG. 4B is a view showing configuration of a mold positioning member according to the embodiment of the present disclosure.

The flat plate-shaped heat insulation member 28 is provided with mold positioning members 34 and 36 used for positioning the mold 16 into the mold holder 14. The mold positioning members 34 and 36 are formed to protrude from an upper surface of the flat plate-shaped heat insulation member 28. FIG. 3 is a plan view showing a configuration of the flat plate-shaped heat insulation member 28. FIG. 4A is a view showing configuration of the mold positioning members 34. FIG. 4B is a view showing configuration of the mold positioning members 36. One circular hole 30 is formed in the center of the flat plate-shaped heat insulation member 28. Semi-elliptic holes 32 are formed on a peripheral edge of the flat plate-shaped heat insulation member 28, at multiple positions such as four positions at substantially regular intervals in the circumferential direction.

The cylindrical mold positioning member 34 protrudes from the upper surface of the flat plate-shaped heat insulation member 28 and is engaged with the circular hole 30. In one embodiment, the cylindrical mold positioning member 34 may have dimensions of an outer diameter A of 20 mm and a height B of 40 mm, for example. The semi-elliptic-cylindrical mold positioning members 36 protrude from the upper surface of the flat plate-shaped heat insulation member 28 and are engaged with the semi-elliptic holes 32, respectively. In one embodiment, each semi-elliptic-cylindrical mold positioning member 36 may have dimensions of a minor axis C of 15.5 mm, a semi-major axis length D of 14 mm, and a height E of 40 mm, for example. The cylindrical mold positioning member 34 and the semi-elliptic-cylindrical mold positioning members 36 are each made of a ceramic such as silicon nitride ($Si_3N_4$), silicon carbide (SiC), and zirconium oxide ($ZrO_2$). The mold positioning members 34 and 36 may be formed separately from the flat plate-shaped heat insulation member 28 or formed integrally therewith. Meanwhile, the shape of each of the cylindrical mold positioning member 34 and the semi-elliptic-cylindrical mold positioning members 36 is not limited to the cylindrical shape or the semi-elliptic-cylindrical shape. For instance, any of the mold positioning members 34 and 36 may have a shape of a polygonal column such as a quadrangular prism.

Figure 5:
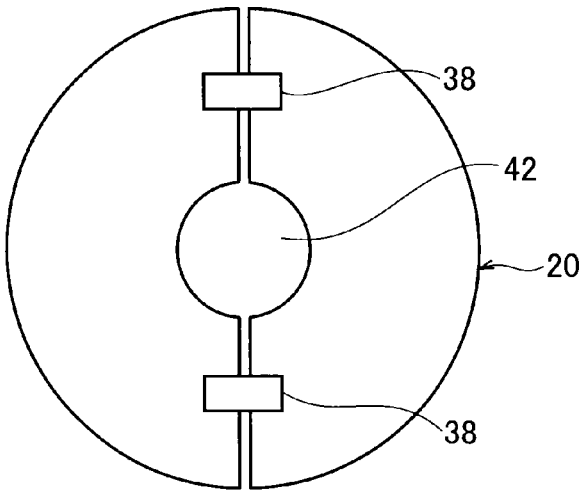
FIG. 5 is a plan view showing a configuration of a lid body according to the embodiment of the present disclosure.

A lid body 20 with a halved structure is provided on the opening on the upper side of the mold holder body 18. FIG. 5 is a plan view showing a configuration of the lid body 20. The lid body 20 is made of a metal material such as stainless steel. A half of the lid body 20 and the other half thereof are capable of restraining each other by way of clamp members 38 provided at two positions, for example. An engagement peripheral groove 40 to be engaged with an outer peripheral edge on the upper side of the mold holder body 18 is provided at an outer peripheral edge of the lid body 20. In addition, an opening 42 to insert a sprue of the mold 16 is formed at a central part of the lid body 20.

Figure 6:
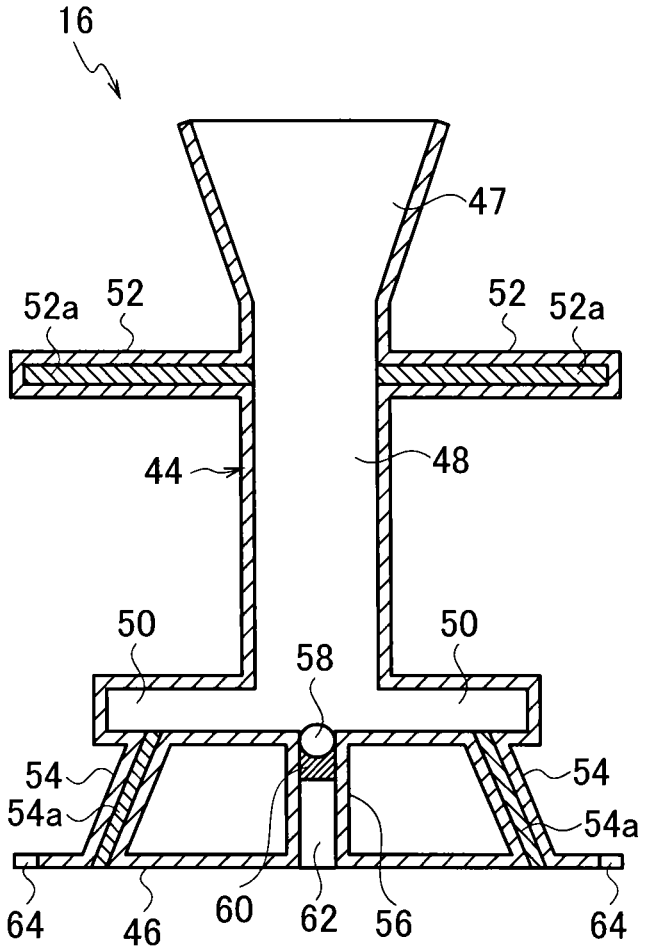
FIG. 6 is a cross-sectional view showing a configuration of a mold according to the embodiment of the present disclosure.

Next, the mold 16 will be described. FIG. 6 is a cross-sectional view showing a configuration of the mold 16. The mold 16 includes a mold body 44 provided with a cavity into which a molten metal such as titanium aluminide, a titanium alloy, and a nickel alloy is poured, and a mold base 46 provided to the mold body 44.

The mold body 44 includes a sprue 47 through which the molten metal is poured, a runner 48 connected to the sprue 47, and a product part 50 connected to the runner 48 and designed to form a product. For example, the sprue 47 is formed into a conical shape while the runner 48 is formed into a cylindrical shape. The product part 50 is formed into a shape of a blade, for example, which constitutes a product. The mold body 44 is formed from a refractory material layer made of a refractory material such as an oxide.

The mold body 44 may be provided with support members 52, which are radially arranged in the circumferential direction. Here, a tip end of each support member 52 is designed to come into contact with an inner peripheral surface of the tubular heat insulation member 26 in the mold holder 14, and thereby to support the mold 16. The support members 52 are each formed into a bar shape, for example, and are provided at four positions at substantially regular intervals radially and almost horizontally in the circumferential direction. Each support member 52 is formed, for example, by coating a bar-shaped ceramic member 52*a* with the refractory material layer.

The mold body 44 may be provided with reinforcement members 54 to reinforce the product part 50. Each reinforcement member 54 is formed, for example, by coating a bar-shaped ceramic member 54*a* with the refractory material layer.

The mold body 44 includes a tubular mold base joint 56 having a shape of a cylinder, for instance. The mold base joint 56 is located at an end of the mold body 44 opposite from the sprue 47, and is designed to attach the mold base 46 thereto. A ceramic ball 58 is put into the tube of the mold base joint 56 in order to prevent the molten metal from flowing out. In addition, a ceramic heat insulation material 60 is filled in the tube.

Figure 7:
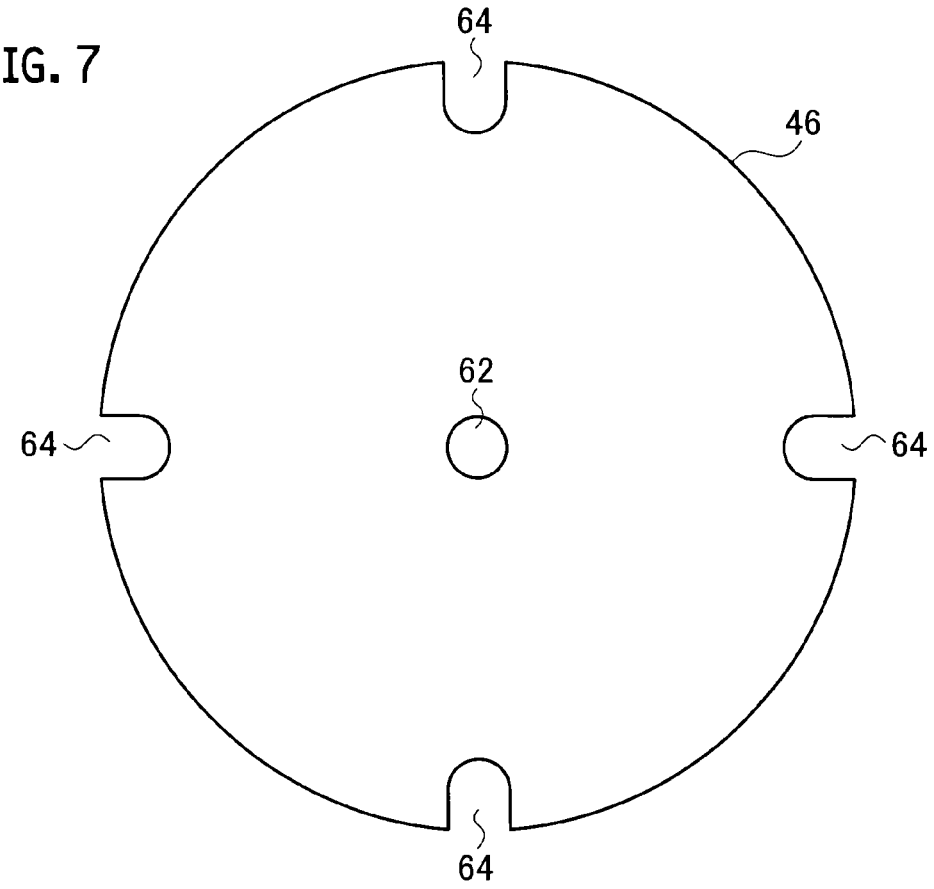
FIG. 7 is a plan view showing a configuration of a mold base according to the embodiment of the present disclosure.

The mold base 46 is attached to the mold base joint 56 on the lower side of the mold body 44. FIG. 7 is a plan view showing a configuration of the mold base 46. The mold base 46 is formed into a flat plate shape such as a shape of a disc. The mold base 46 is made of a refractory material such as an oxide, or may be formed from the same refractory material layer as the mold body 44.

The mold base 46 includes mold positioning member insertion holes 62 and 64, which are engageable with the cylindrical mold positioning member 34 and the semi-elliptic-cylindrical mold positioning members 36 of the mold holder 14. One circular mold positioning member insertion hole 62, which allows insertion of and is thereby engageable with the cylindrical mold positioning member 34 of the mold holder 14, is provided in the center of the mold base 46. Meanwhile, semi-elliptic-cylindrical mold positioning member insertion holes 64, which allow insertion of and are thereby engageable with the semi-elliptic-cylindrical mold positioning members 36, are provided on an outer peripheral edge of the mold base 46. The semi-elliptic-cylindrical mold positioning member insertion holes 64 are formed at multiple positions such as four positions at substantially regular intervals in the circumferential direction, as cutout holes by cutting out the peripheral edge of the mold base 46.

Next, a method of manufacturing the mold 16 will be described.

Figure 8:
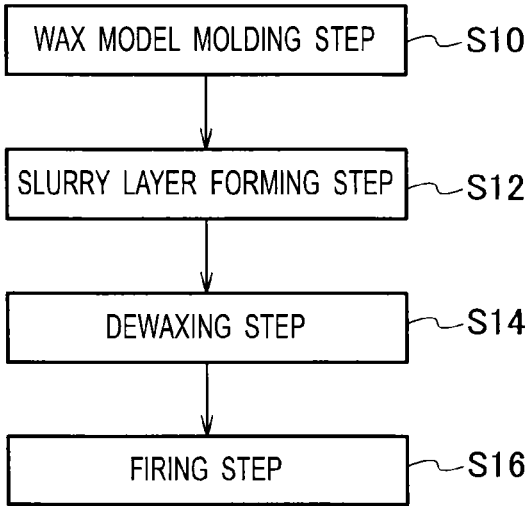
FIG. 8 is a flowchart of a method of manufacturing a mold according to the embodiment of the present disclosure.
Figure 9A:
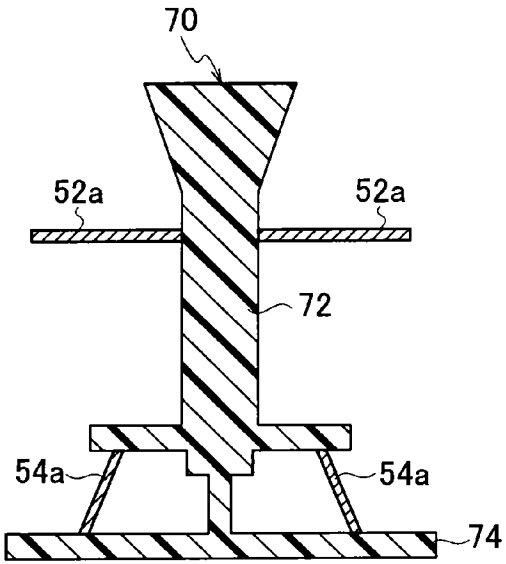
FIG. 9A is a cross-sectional view for explaining a wax model molding step in the method of manufacturing a mold according to the embodiment of the present disclosure.
Figure 9B:
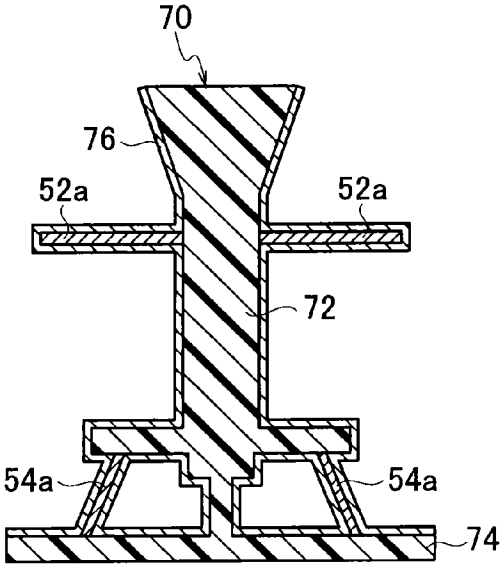
FIG. 9B is a cross-sectional view for explaining a slurry layer forming step in the method of manufacturing a mold according to the embodiment of the present disclosure.
Figure 9C:
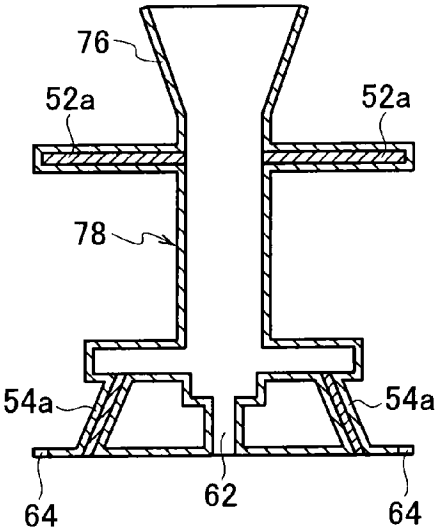
FIG. 9C is a cross-sectional view for explaining a dewaxing step in the method of manufacturing a mold according to the embodiment of the present disclosure.

FIG. 8 is a flowchart of the method of manufacturing the mold 16. The method of manufacturing the mold 16 includes a wax model molding step (S10), a slurry layer forming step (S12), a dewaxing step (S14), and a firing step (S16). FIG. 9A is a cross-sectional view for explaining the wax model molding step (S10) in the method of manufacturing the mold 16. FIG. 9B is a cross-sectional view for explaining the slurry layer forming step (S12) in the method of manufacturing the mold 16. FIG. 9C is a cross-sectional view for explaining the dewaxing step (S14) in the method of manufacturing the mold 16.

The wax model molding step (S10) is a step of molding a wax material into a wax model 70 for forming the mold body 44 and the mold base 46. As shown in FIG. 9A, the wax model 70 includes a portion 72 to form the mold body 44 and a portion 74 to form the mold base 46. The bar-shaped ceramic members 52*a* for forming the support members 52 may be attached by means of adhesion or the like to the portion 72 to form the mold body 44. Meanwhile, the bar-shaped ceramic members 54*a* for forming the reinforcement members 54 may be attached by means of adhesion or the like to the portion 72 to form the mold body 44 and the portion 74 to form the mold base 46.

The slurry layer forming step (S12) is a step of coating the wax model 70 with a slurry layer 76 made of the refractory material. First, an outer peripheral surface and a lower surface of the portion 74 to form the mold base 46 are subjected to masking with resin tapes and the like before coating the wax model 70 with the slurry layer 76. Next, the wax model 70 is coated with the slurry layer 76. A method of coating the slurry layer 76 is conducted by repeating a coating treatment of slurry obtained by mixing the refractory material and a binder, and stuccoing. Cerium oxide ($CeO_2$), yttrium oxide ($Y_2O_3$), zirconium oxide ($ZrO_2$), or the like is used as the refractory material. Colloidal silica or the like is used as the binder.

The masking is removed after the wax model 70 is coated with the slurry layer 76, and then the slurry layer 76 is dried sufficiently. Hence, the slurry layer 76 covers around the wax model 70 as shown in FIG. 9B. Note that the outer peripheral surface and the lower surface of the portion 74 to form the mold base 46 subjected to the masking are not coated with the slurry layer 76.

The dewaxing step (S14) is a step of removing the wax material by heating the wax model 70 coated with the slurry layer 76 and thereby forming a mold green compact 78. As shown in FIG. 9C, the mold green compact 78 is formed by melting and removing the wax material out of the wax model 70 coated with the slurry layer 76. The dewaxing is conducted by putting the wax model 70 coated with the slurry layer 76 into an autoclave or the like, and performing heating and pressure treatments at a temperature in a range from 100° C. to 180° C. and at a pressure in a range from 4 atm (0.4 MPa) to 8 atm (0.8 MPa). By melting and removing the wax material, the mold green compact 78 is provided with the sprue 47, the runner 48, the product part 50, the circular mold positioning member insertion hole 62, and the like. Then, the semi-elliptic-cylindrical mold positioning member insertion holes 64 are provided to the mold green compact 78 by machining and the like. Here, the semi-elliptic-cylindrical mold positioning member insertion holes 64 may be formed by machining and the like after the firing step (S16) instead.

The firing step (S16) is a step of firing the mold green compact 78. The mold green compact 78 is heated and fired in a firing furnace or the like at a temperature in a range from 900° C. to 1300° C. Accordingly, the slurry layer 76 is sintered into a shell, and the mold 16 is thus formed. Then, the opening of the mold base joint 56 is closed by putting the ceramic ball 58 into the opening, and the ceramic heat insulation material 60 is filled therein. Thus, the mold 16 is manufactured. The above method of manufacturing the mold 16 describes the case of integrally forming the mold body 44 and the mold base 46. Instead, the mold body 44 and the mold base 46 may be formed separately and then manufactured into the mold 16 by joining and the like.

Next, a centrifugal casting method using the centrifugal casting apparatus 10 will be described.

Figure 10:
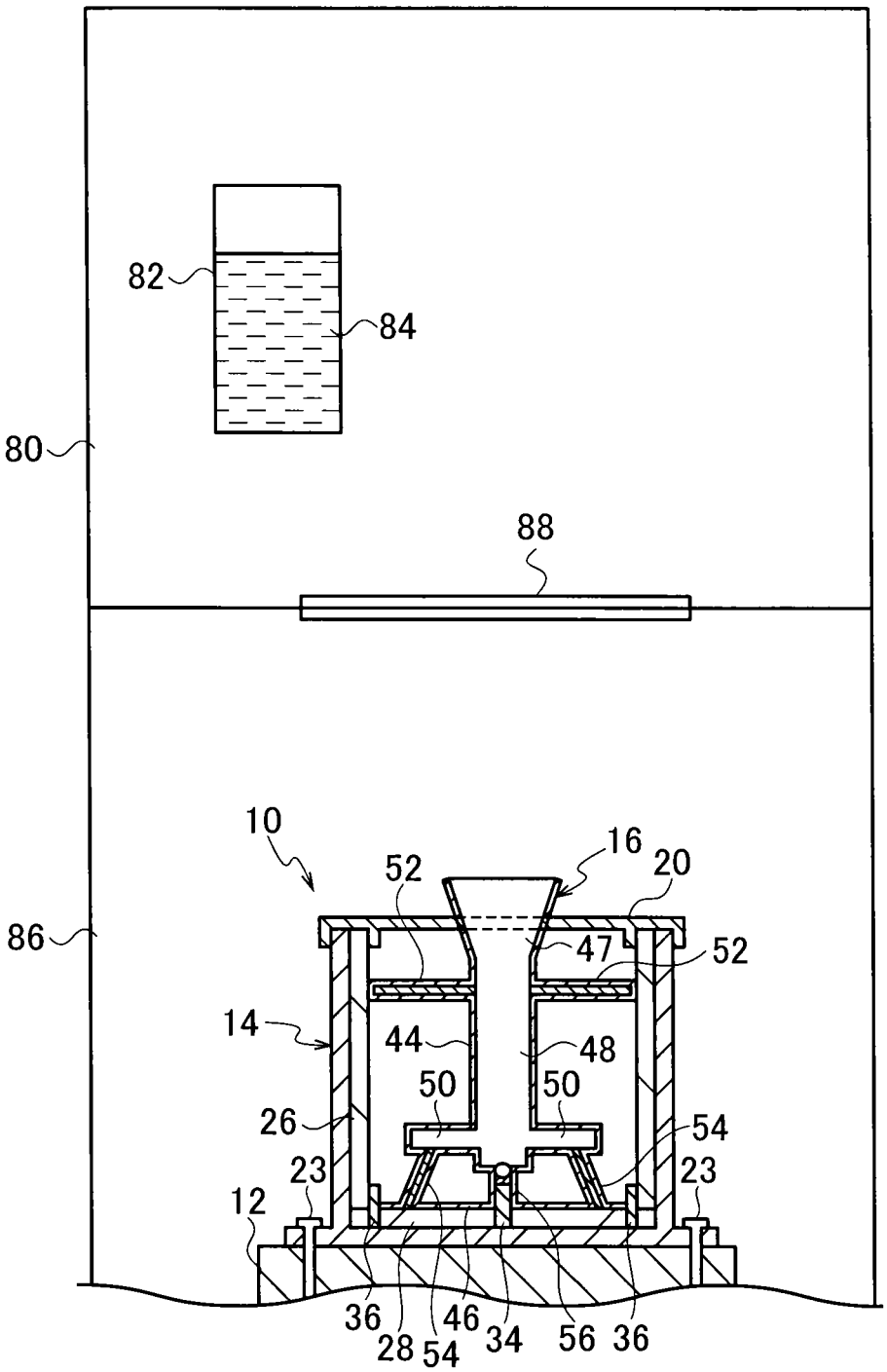
FIG. 10 is a schematic diagram showing a centrifugal casting method using the centrifugal casting apparatus according to the embodiment of the present disclosure.

FIG. 10 is a schematic diagram showing the centrifugal casting method using the centrifugal casting apparatus 10. Vacuum melting of a titanium aluminide alloy, a titanium alloy, a nickel alloy, or the like is performed in a melting chamber 80, and a molten metal 84 in a melting crucible 82 is maintained at a predetermined temperature.

The mold holder 14 is placed on the rotary table 12 in a mold chamber 86, and the mold holder 14 is fastened and fixed to the rotary table 12 by using the fastening members 23 such as bolts. Next, the mold 16 preheated in a preheating furnace is set to the mold holder 14. The heated mold 16 is inserted into the mold holder 14, and the cylindrical mold positioning member 34 of the mold holder 14 is inserted into and engaged with the circular mold positioning member insertion hole 62 in the mold 16. Moreover, the semi-elliptic-cylindrical mold positioning members 36 of the mold holder 14 are inserted into and engaged with the semi-elliptic mold positioning member insertion holes 64 in the mold 16. Then, while the sprue 47 of the mold 16 is exposed from the opening 42 of the lid body 20, the opening of the mold holder 14 is covered with the lid body 20. Thus, the mold 16 is positioned to and held by the mold holder 14.

The mold chamber 86 is depressurized by vacuuming the mold chamber 86. A partitioning valve 88 that partitions between the melting chamber 80 and the mold chamber 86 is opened when the mold chamber 86 achieves a predetermined degree of vacuum. An elevator is moved up so as to move the mold 16 held by the mold holder 14 to an upper part in the mold chamber 86. After the rotary table 12 is rotated to reach a predetermined rotational speed, the molten metal 84 in the melting crucible 82 is poured into the mold 16 and is cast accordingly. After the casting, the rotation of the rotary table 12 is stopped and the elevator is moved down so as to move the mold 16 held by the mold holder 14 to a lower part in the mold chamber 86 for cooling. Then, after the cooling, the mold 16 is taken out of the mold holder 14.

According to the above-described configuration, the mold holder includes the mold positioning members, and the mold includes the mold base provided with the mold positioning member insertion holes which are engageable with the mold positioning members. Thus, it is possible to position the mold easily into the mold holder by attaching the mold while bringing the mold positioning member insertion holes in the mold base in engagement with the mold positioning members of the mold holder. Accordingly, the mold can be attached more easily. Furthermore, in the case of attaching the mold preheated in the preheating furnace, it is possible to perform an operation to attach the mold more easily, so that the operation to attach the mold is completed in a short time. Hence, a drop in temperature of the mold can be reduced.

The present disclosure allows positioning of a mold into a mold holder easily, and is therefore useful for centrifugal casting of a titanium aluminide precision casting product, a titanium alloy precision casting product, a nickel alloy precision casting product, and the like.

What is claimed is:

1. A centrifugal casting apparatus comprising:

a mold holder placed on a freely rotatable rotary table; and a mold put into and held by the mold holder, wherein the mold holder includes a mold holder body made of a metal material and having a bottomed cylindrical shape, heat insulation members provided on an inner peripheral surface and a bottom surface of the mold holder body, and a mold positioning member made of a ceramic and provided to protrude from the heat insulation member on the bottom surface of the mold holder body, and the mold includes a mold body made of an oxide and having a cavity into which a molten metal is to be poured, and a mold base made of an oxide, provided to the mold body, and having a mold positioning member insertion hole engageable with the mold positioning member.

2. The centrifugal casting apparatus according to claim 1, comprising:

a plurality of the mold positioning members; and a plurality of the mold positioning member insertion holes.

3. The centrifugal casting apparatus according to claim 2, wherein one of the mold positioning members is provided in the center of the heat insulation member on the bottom surface of the mold holder body and the remaining mold positioning members are provided on a peripheral edge of the heat insulation member on the bottom surface of the mold holder body, and one of the mold positioning member insertion holes is provided in the center of the mold base and the remaining mold positioning member insertion holes are provided on a peripheral edge of the mold base.

4. The centrifugal casting apparatus according to claim 3, wherein the remaining mold positioning member insertion holes provided on the peripheral edge of the mold base are each formed into a cutout hole.

5. The centrifugal casting apparatus according to claim 1, wherein each of the mold positioning members is made of any of silicon nitride, silicon carbide, and zirconium oxide.

6. The centrifugal casting apparatus according to claim 1, wherein the mold comprises a plurality of support members provided to the mold body in radial arrangement and designed to support the mold by bringing tip ends of the support members into contact with the heat insulation member provided on the inner peripheral surface of the mold holder body.

7. The centrifugal casting apparatus according to claim 1, wherein the mold which is preheated is held by the mold holder.

* * * * *